United States Patent [19]

Malminen et al.

[11] 4,127,996

[45] Dec. 5, 1978

[54] KEY PROFILE SYSTEM

[75] Inventors: Henrikki Malminen; Kaarlo Martikainen, both of Joensuu, Finland

[73] Assignee: Oy Wartsila AB, Helsinki, Finland

[21] Appl. No.: 837,641

[22] Filed: Sep. 28, 1977

[30] Foreign Application Priority Data

Oct. 4, 1976 [FI] Finland ..... 762819

[51] Int. Cl.[2] ..... E05B 19/02; E05B 27/08

[52] U.S. Cl. ..... 70/365; 70/403; 70/406; 70/411

[58] Field of Search ..... 70/365, 366, 402, 403, 70/406, 407, 409, 411

[56] References Cited

U.S. PATENT DOCUMENTS 1,782,464 11/1930 Falk ..... 70/406

FOREIGN PATENT DOCUMENTS 1065824 4/1967 United Kingdom ..... 70/409

*Primary Examiner*—Robert L. Wolfe

*Attorney, Agent, or Firm*—Haseltine, Lake & Waters

[57] ABSTRACT

A key profile system of a disc cylinder lock is disclosed in which system the appropriateness of a certain key profile for use in a lock is determined by the form of a key receiving opening in the actual locking elements of the lock, that is, the locking discs. The system comprises several different key profiles the form of which can be included within the border line of the basic profile of the used key blank. At least one of the key profiles fits functionally into a lock made for another key profile. The system may also include keys or key blanks with at least two different profiles arranged axially one after the other.

8 Claims, 27 Drawing Figures

KEY PROFILE SYSTEM

Figure 1:
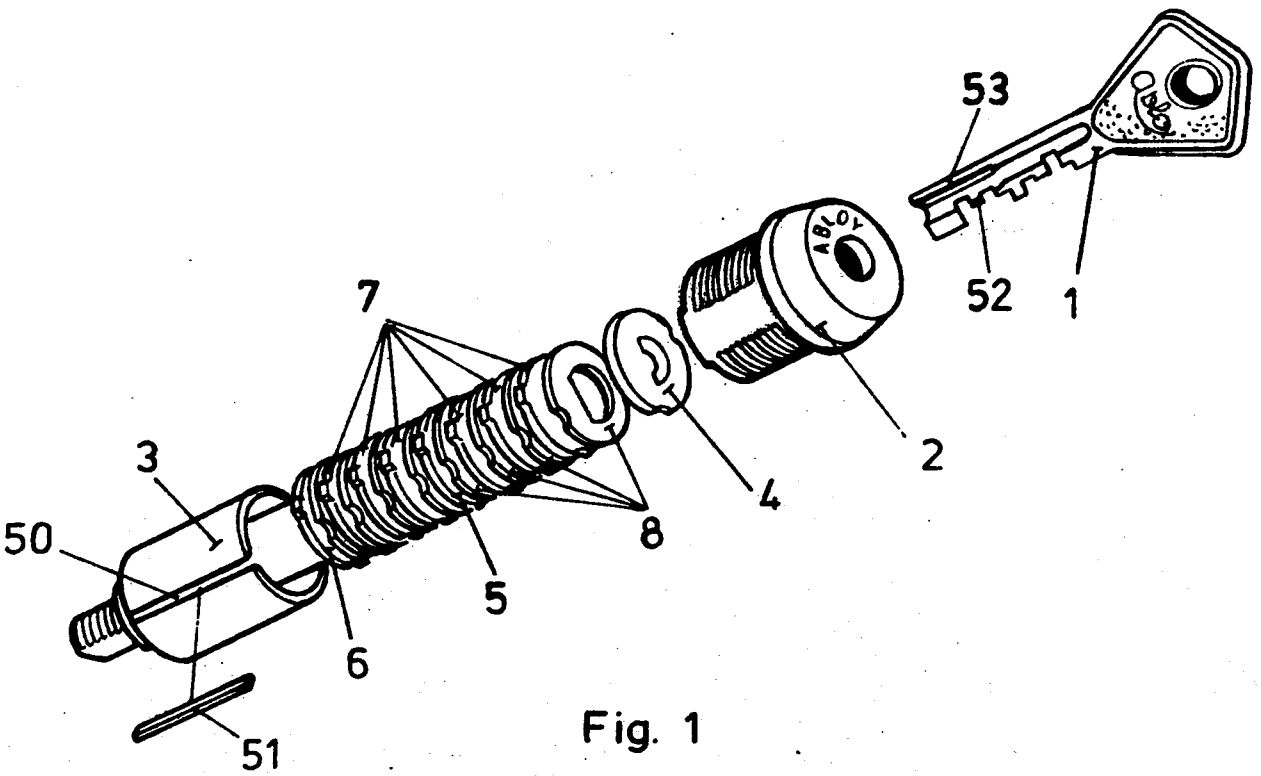

The invention relates to a key profile system of a disc cylinder lock in which system the appropriateness of a certain key profile for use in a lock is determined by turnable locking discs acting as locking elements of the lock, and in said discs by the applied form of a central opening for the key of the lock.

In this specification and in the claims, the expression "key profile" means the cross-sectional configuration of the blade of a key blank before any individualizing key combination cuts have been made therein. The expression "disc cylinder lock" means a cylinder lock with turnable locking discs which are turned by turning the key from an initial key insertion position to a position releasing the lock mechanism.

A lock system has a certain number of key combinations which can be very great, but, nevertheless, is limited. To multiply this limited number of key combinations it is known to use new key profiles, the using possibilities of which are completely separated from each other. In other words, keys with a certain key profile fit only into locks made for this key profile. To some extent one has also understood to combine the using range of different key profiles to create certain mastered lock systems. This, however, has been accomplished only so, that there has been one large profile into the lock of which some smaller key profiles has fitted, while the locks made for the small key profiles have been functionally completely separated from each other.

The object of the invention is to create a generalized key profile system applicable to disc cylinder locks, the using possibilities of which are considerably larger and the fitness of which, specially for different mastered systems, is considerably better than in known locks. The invention is characterized in that the key profile system comprises several different profiles the form of which can be included within the border line of the basic profile of the key blank used, and of which at least one profile functionally fits into a lock made for another profile. This kind of system creates an almost ideal basis for the creation of very far developed mastered systems.

A profile system according to the invention can be further developed so that within the limits of said basic profile there is a profile series in which each profile functionally fits into a lock made for the basic profile but in which there is at least one profile which does not fit into a lock made for another profile. This kind of system gives the possibility to keep certain profiles functionally apart from the other profiles of the same system. This idea can be further developed by using two different profile series so that the profiles of the one series does not fit into locks made for the profiles of the other series.

A system comprising several profile series can, by forming the profiles suitably, be provided with a general profile which fits at least the majority of the locks made for the different profiles of the different profile series. This is of special importance in such mastered systems where there is an extensive master key locking. This idea in turn can be further developed so that the profile system comprises several profile series of which each comprises at least one profile which also fits into locks made for some of the profiles of the other series.

The profile system according to the invention can in a very simple way be further developed so that in the same key there are at least two different profiles arranged axially one after the other of which the profile of the front end of the key, that is the end which is first inserted into the lock, can be included within the border line of a profile closer to the opposite end of the key. This system gives very great possibilities to bild up a large profile system. No complicated changes in the lock are necessary when two different profiles are used in the same key, the only necessary step is that two or several different key opening forms are used in the locking discs of the same lock so that restricting elements corresponding to the key profiles are formed in the keyway of the lock. The manufacture of a key fitting into a lock of this type should be so organised that key blanks with a different profile at different sections are made at the lock factory and only there and the key blanks are then distributed to the locksmiths which then only take care of the milling of the key combinations.

Figure 7:
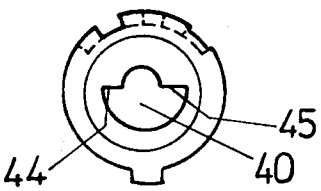
Figure 8:
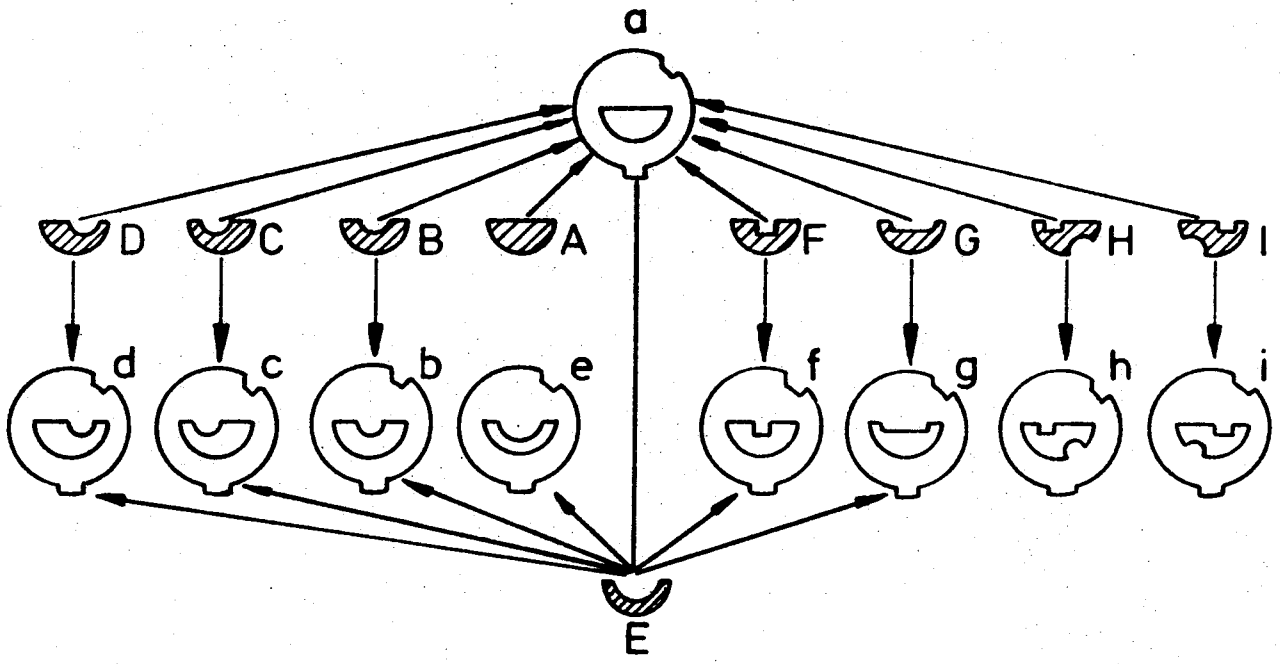
Figure 9:
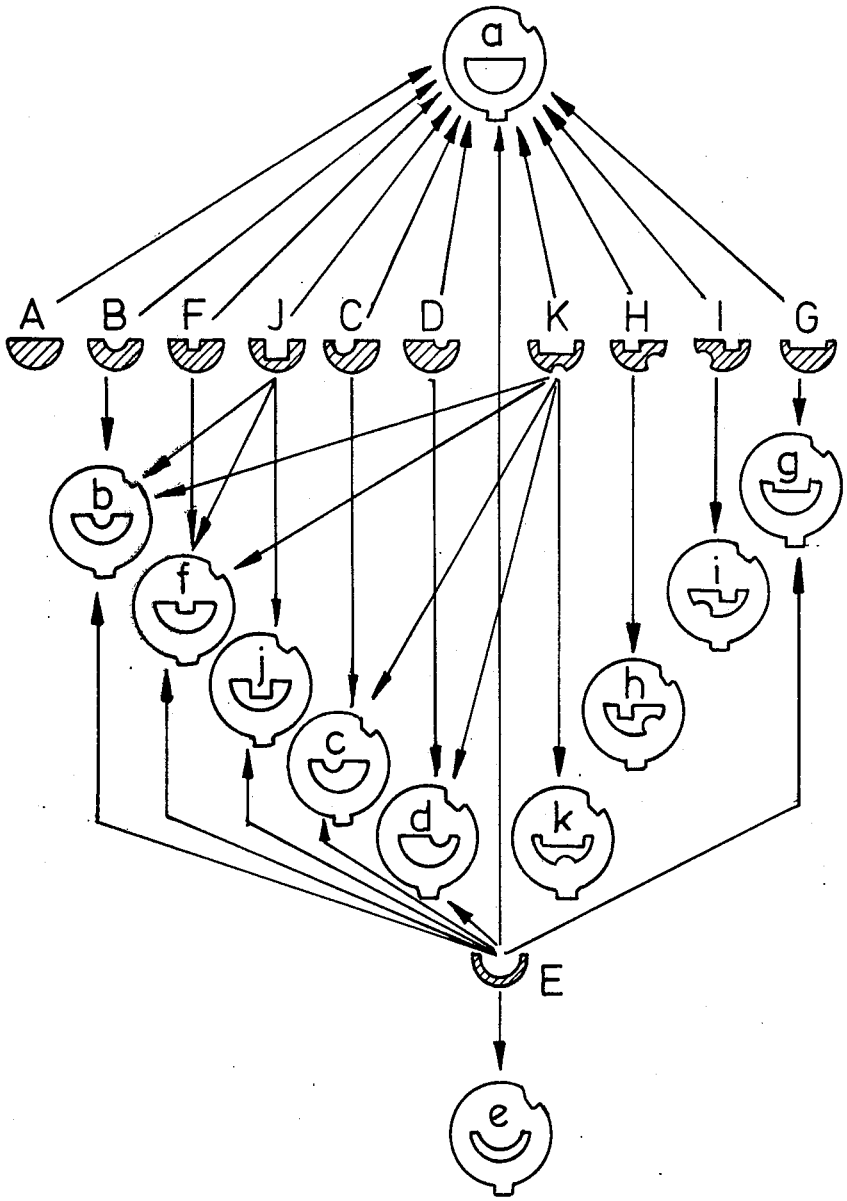
Figure 22:
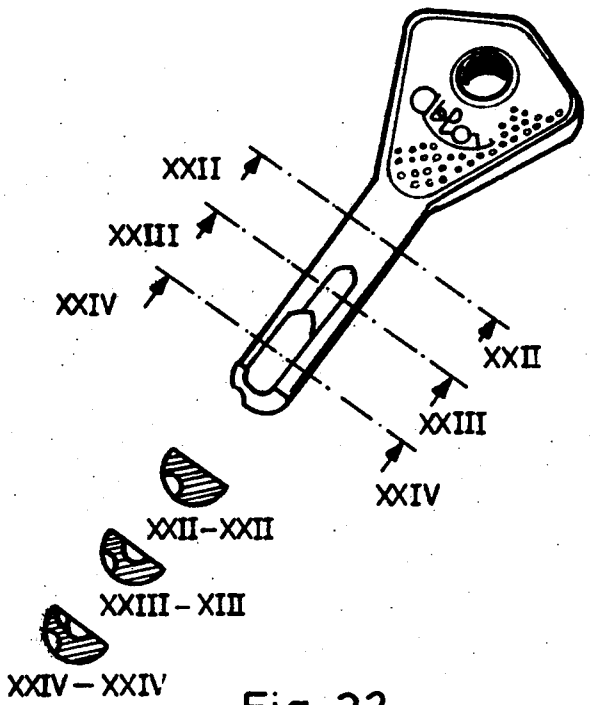
Figure 23:
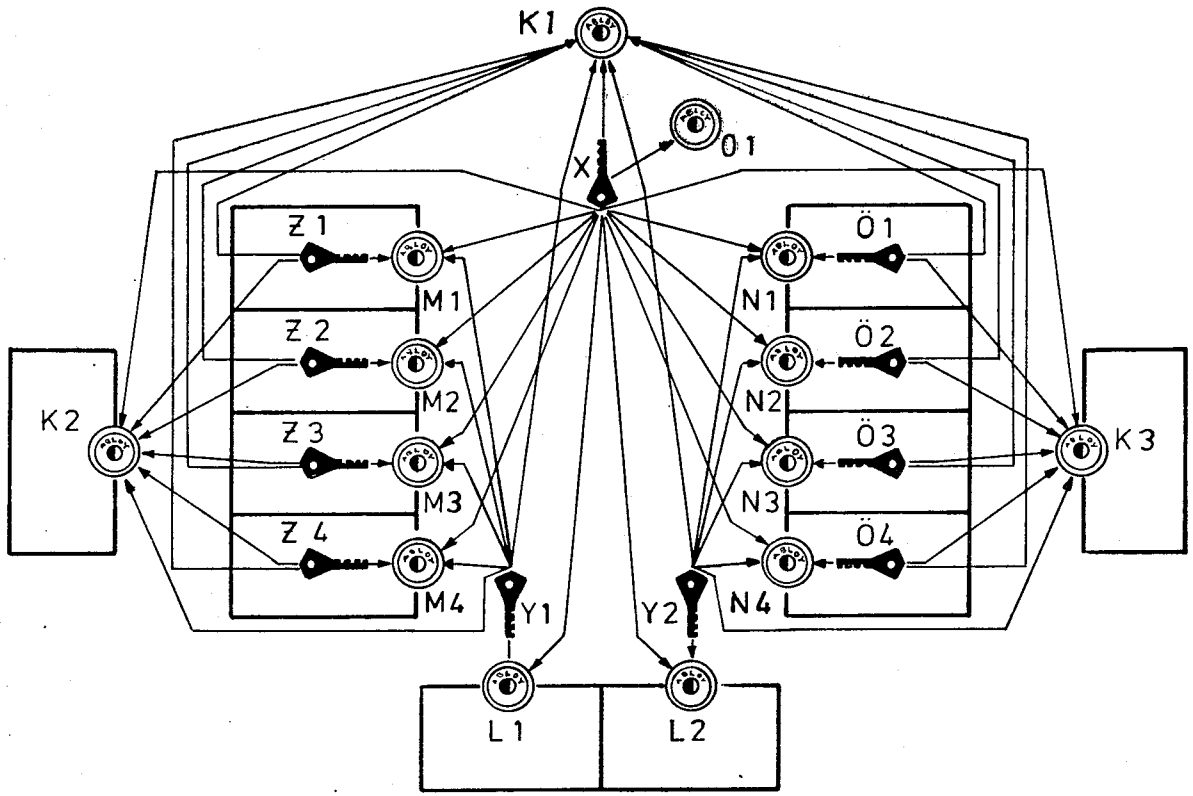

In the following, the invention is described more in detail with reference to the attached drawings in which FIG. 1 shows an expanded general perspective view of a disc cylinder lock, FIGS. 2, 10, 15–22 and 24–27 show key blanks for different locks according to the invention and their profiles, FIGS. 3–7 show locking discs for different key profiles FIGS. 8 and 9 show principal schemes of profile systems according to the invention FIGS. 11–14 show locking discs for key profiles according to FIG. 10 and corresponding key profiles FIG. 23 shows a principal scheme of a mastered locking system In FIG. 1, the numeral 1 indicates a key with a special profile key blade more clearly shown in FIG. 2. The member 2 is the cylinder housing of the lock and the member 3 the rotatable cylinder of the lock. The cylinder is filled with a pile of discs comprising locking discs 4, 5, 6, and 7 and between them, intermediate discs 8. The disc 4, the outermost locking disc of the disc pile, is shown more clearly in FIG. 3. The disc 5, a locking disc in the interior of the disc pile, is more clearly shown in FIG. 4. The disc 6, the innermost locking disc of the disc pile, is more clearly shown in FIG. 5. The discs 7 are the other locking discs of the lock and they are more clearly shown in FIGS. 6 and 7. A locking bar 51 is movable in a slot 50 and locks the cylinder 3 to the cylinder housing 2. In the unlocking position of the lock, the locking bar 51 is able to move radially inwards into a groove formed by peripheral recesses 46 in the locking discs (FIGS. 3–7), thereby freeing the cylinder 3.

Figure 2:
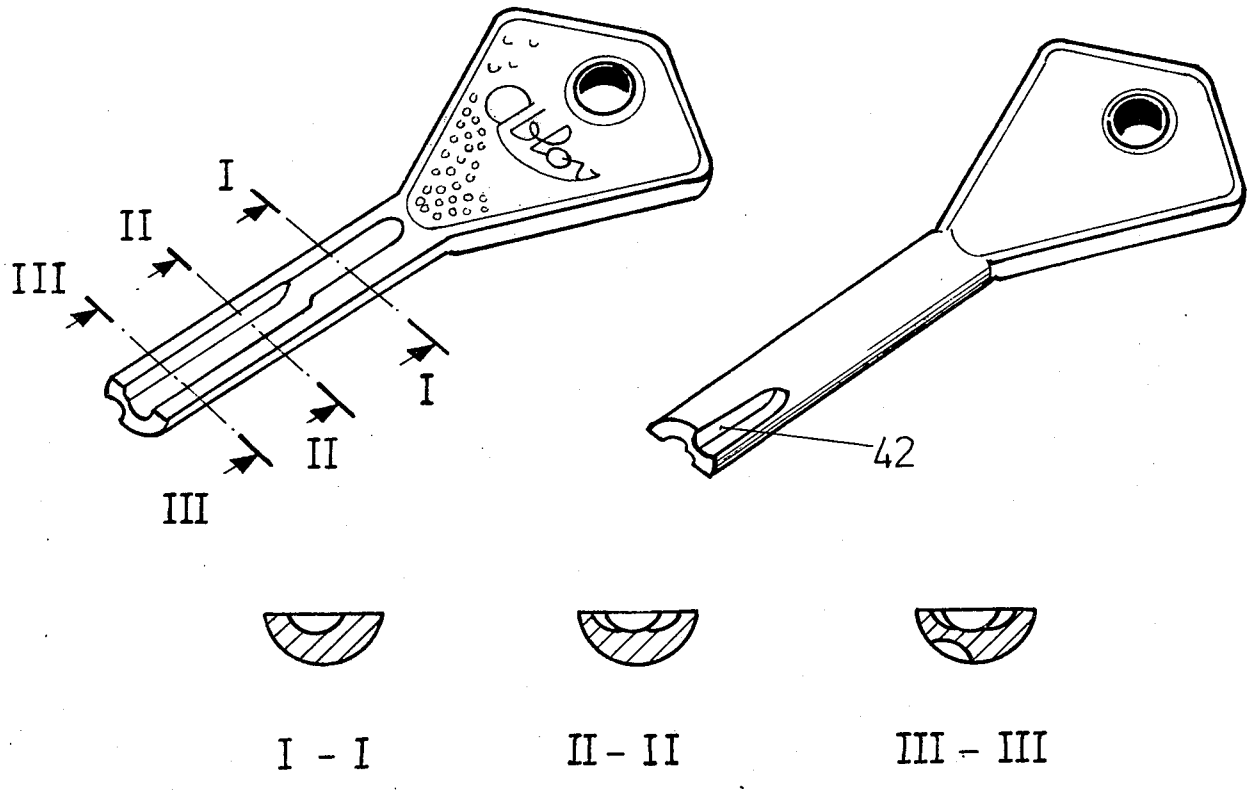
Figure 5:
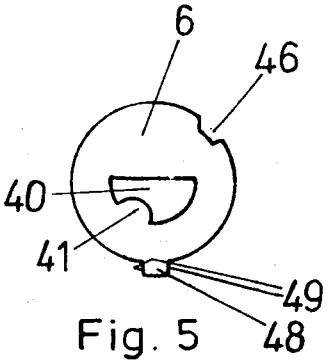

FIG. 2 shows more in detail a key blank for a cylinder lock according to FIG. 1, from which key blank the sectors characteristic for the key combination have not yet been milled off to form the necessary combination surfaces 52 (FIG. 1). The key blank has a different profile at different sections of the key blade. Section I—I shows the profile of the back end of the key blade, section II—II the profile of the middle portion of the key blade, and section III—III the profile of the front end of the key blade. In the lock, there are locking discs functionally corresponding to these profiles. The locking disc 4 of FIG. 1 corresponds functionally to profile I—I, locking disc 5 corresponds to profile II—II, and locking disc 6 corresponds to profile III—III. The locking discs 7 are general locking discs with a central opening corresponding to the basic profile of the key without grooves. Consequently, it is not necessary to use locking discs exactly corresponding to the key profile, instead such locking discs are used as a first locking disc in the sections where the key must have a certain profile. Of course, this does not prevent the use of locking discs corresponding to the actual key profile all over the section of this profile, but this is not necessary, because already the central opening of the first locking disc of the section in question determines the maximum size of the key profile which can be used.

Figure 4:
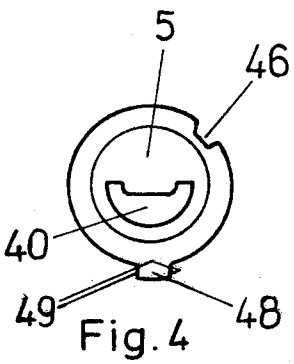
Figure 3:
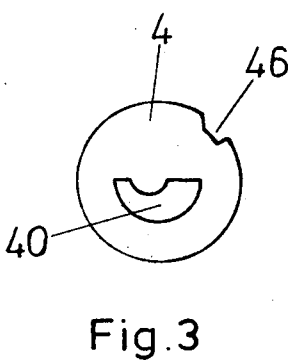

The first locking disc 4 of the lock shown in FIG. 1, which disc is intended for the key profile I—I shown in FIG. 2, is shown more clearly in FIG. 3. Correspondingly, the locking disc 5, in the middle of the locking disc pile, is shown more clearly in FIG. 4, and the innermost locking disc 6 in FIG. 5. In FIGS. 3 and 4, the key opening 40 of the locking disc corresponds roughly to the key profiles I—I and II—II, respectively, but the key opening of the locking disc 6 is in its upper portion larger than the key profile III—III in order to make the manufacture easier. This is quite possible, because at the opposite side of the key opening there is a radially inwardly extending projection 41 due to which it is not possible to use, in the shown lock, a key which has not the groove 42 shown in FIG. 2.

Figure 6:
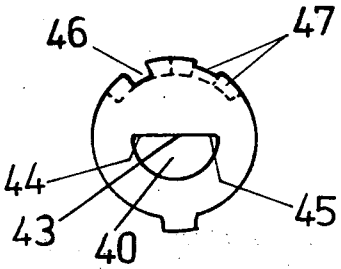

In the lock shown in FIG. 1, the general locking discs 7 which are not used to determine a certain special profile, correspond to the locking discs shown in FIGS. 6 and 7. The key opening 40 of a locking disc comprises two functionally important portions: both ends 44 and 45 of the linear edge 43 of the opening. One of these portions is influenced by the combination surface 52 (FIG. 1) for turning the locking disc into its unlocking position, while the opposite end of the linear edge 43 is influenced by the reset surface 53 (FIG. 1) for turning the locking disc into its initial position, that is, the insertion and withdrawal position of the key. Since only the ends of the linear edge 43 act as force transmitting surfaces, the middle portion 43 of the linear edge is not needed and the key opening may also correspond to the embodiment shown in FIG. 7. In FIGS. 3–7, also the peripheral recess 46 of the locking discs is shown, into which the locking bar moves in the unlocking position of the lock, and in FIGS. 6 and 7 there are also shown a number of false recesses 47, the object of which is to complicate picking of the lock.

The combination surfaces 52 (FIG. 1) of the key are made by removing, in a key milling machine or the like, sectors of different sizes from one half of the key blade at positions corresponding to the different locking discs. Usually, six different combination surface millings are used, zero milling and the milling of one to five sector steps. In this case zero milling, which means that no milling is made at all, turns a locking disc through the greatest angle, and a five-step milling, that is, the maximum milling, does not turn the locking disc at this position at all. The millings can, principally, be made in the same way irrespective of the form of the key profile. Due to this and because milling of key combination surfaces as described is known per se, it is not here explained more in detail.

In FIG. 8, a profile system according to the invention is schematically shown. In the Figure different key profiles are indicated by capital letters and corresponding key openings in the locking discs are indicated by small letters. Arrows indicate into what key opening each profile fits. All profiles fit into the key opening a of the basic profile and the general profile E fits into almost all the key openings of this system but not into the openings h and i. It is always possible to bild up a profile system so that it is not even theoretically possible to invent a general profile which would fit into all the locks of the system. The space available to form a general profile is determined in principle by placing all the key openings of the system one above another to find out what the remaining light opening looks like. The general profile has to fit into this light opening. If the openings have such a form that no continuous light opening is formed, there is no general profile which would fit into all the locks of the system.

A system with a certain recemblance of the system shown in FIG. 8 is shown in FIG. 9, however it contains a greater number of key profiles fitting into locks for several different profiles. For instance, the profile J fits into the openings a, b, f and j, the profile K fits into the openings a, b, f, c, d and k, and correspondingly, the profile E fits into the openings a, b, f, j, c, d and g. All these possibilities can with advantage be used in the design of different mastered lock systems.

Figure 10:
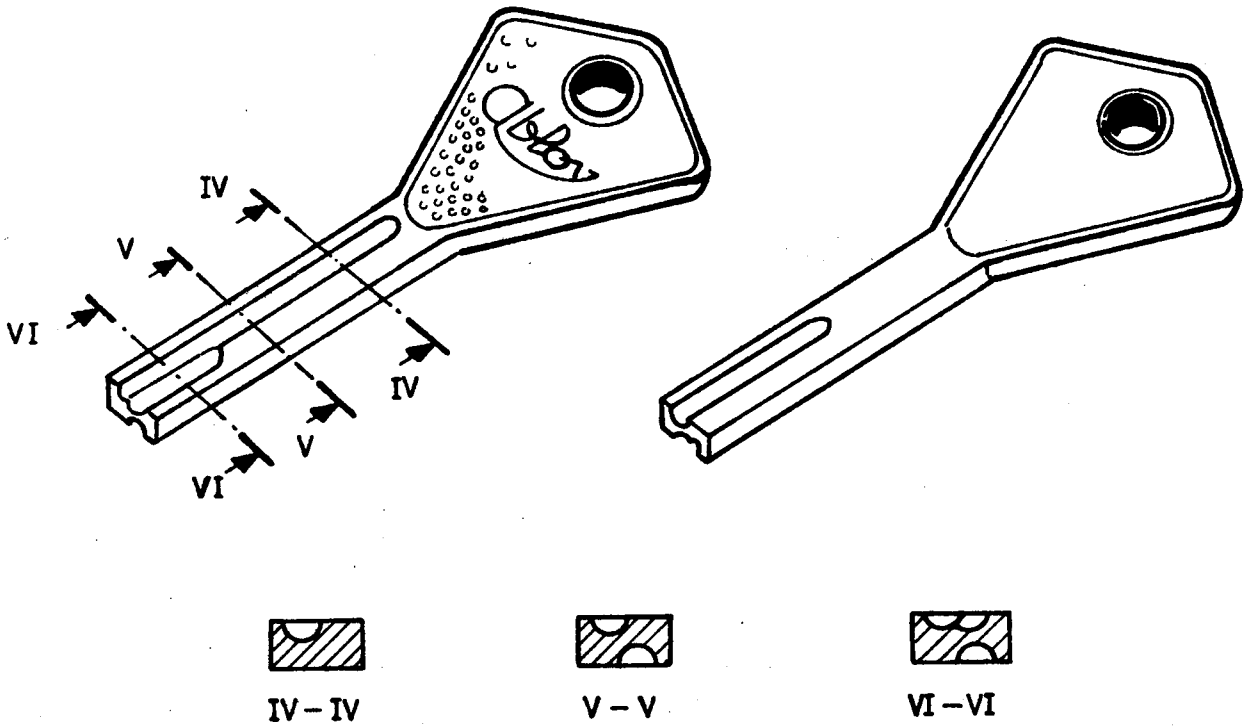
Figures 11, 12, 13, 14:
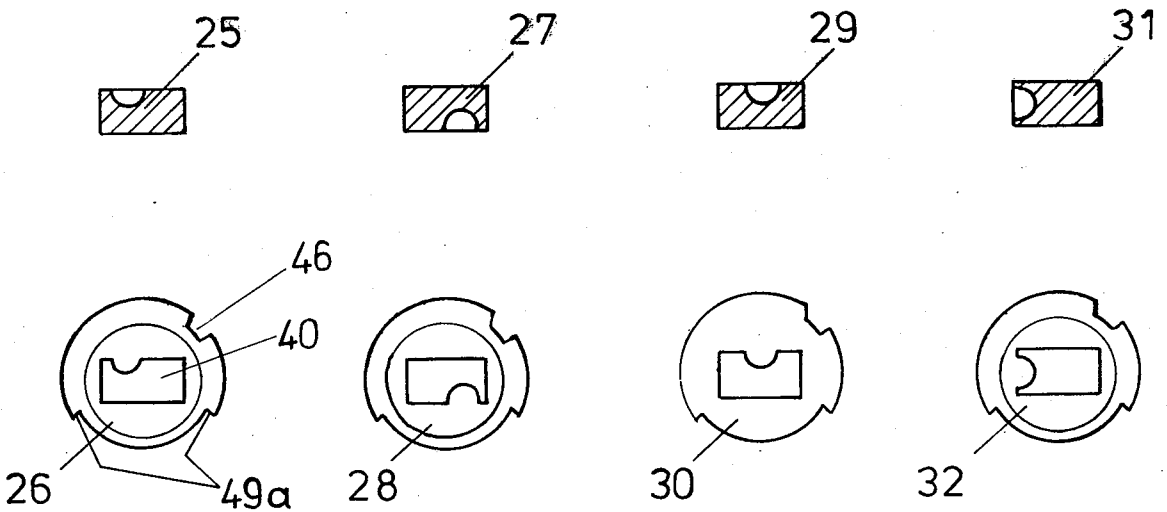

FIG. 10 shows a key blank with a rectangular basic profile. Within the scope of this basic profile it is also possible to form a great number of smaller profiles belonging to the same profile family as sections IV—IV, V—V and VI—VI show. A profile family based on a rectangular figure may fall within the outer borders of the semicircular basic profile shown in FIG. 2 or the situation may be the opposite. In both cases these two profile families and their locking systems can under certain circumstances be combined. It is also possible that the two profile families in question form two completely separate systems.

FIGS. 11–14 show other profiles belonging to the rectangular profile family and corresponding locking discs. In comparison to the locking discs shown in FIGS. 3–7, the shown locking discs are different in that the member limiting the turning movement of the locking discs is not formed by the side surfaces 49 of the tongue 48 but by inwardly extending surfaces **49*a* to which correspond radial stop surfaces at the inside of the lock cylinder 3**.

Figure 16:
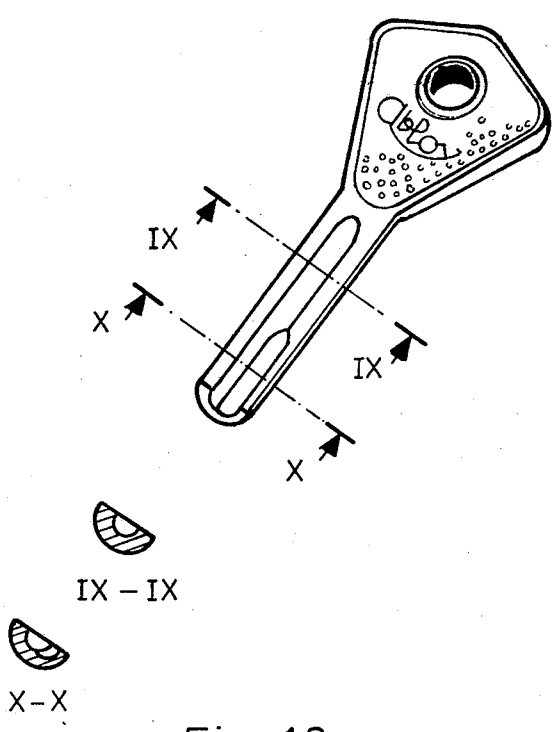
Figure 15:
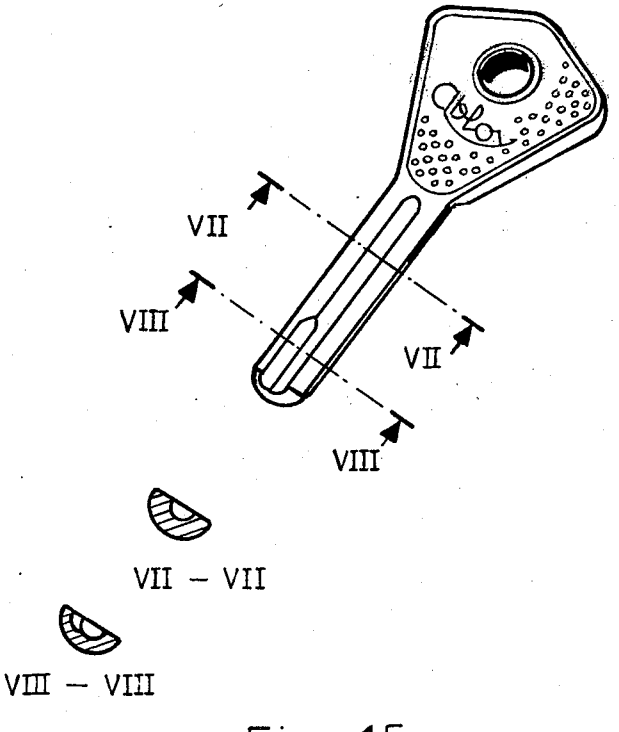

FIGS. 15 and 16 show how from a certain basic profile two keys are made which cannot be used in the same lock due to the fact that in the front end of the one key there is a left hand additional groove and in the other key a right hand additional groove.

Figure 18:
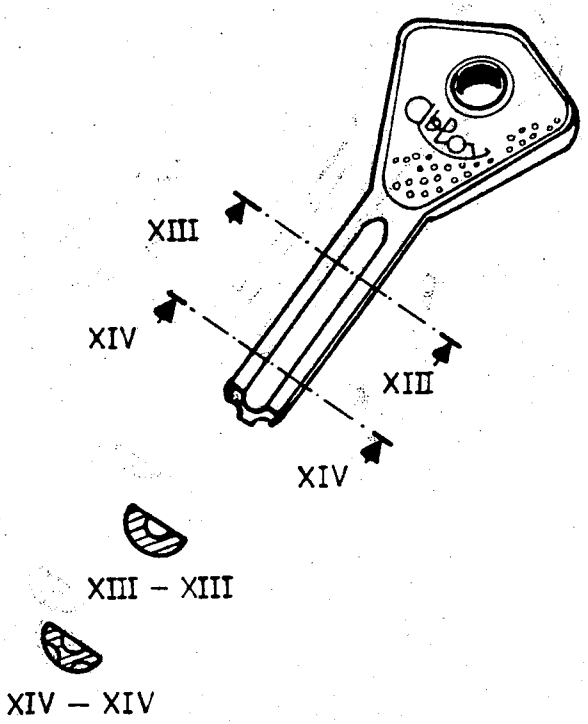
Figure 17:
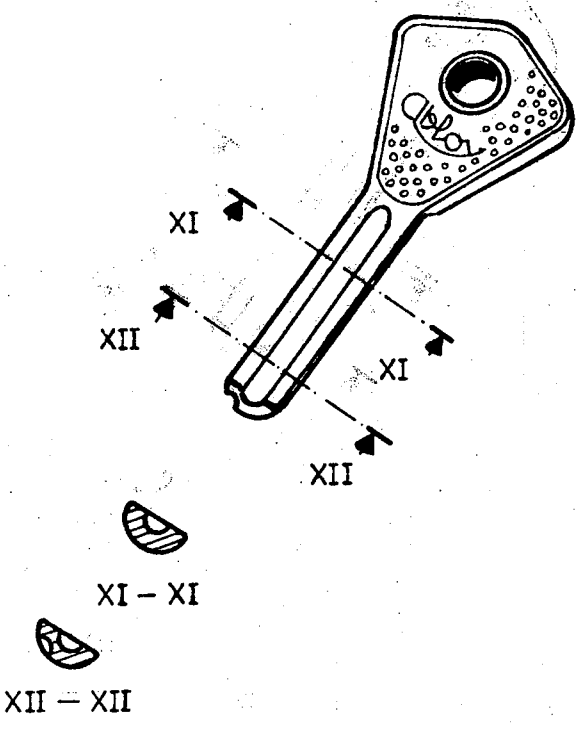

FIGS. 17 and 18 show an example where a key according to FIG. 18 functionally fits into a lock made for a key according to FIG. 17 but a key according to FIG. 17 does not fit into a lock made for a key according to FIG. 18. In the shown example, an additional groove is made only in the front end of the key on its convex side but as well the additional groove could have been extended over the whole length of the key blade.

Figure 20:
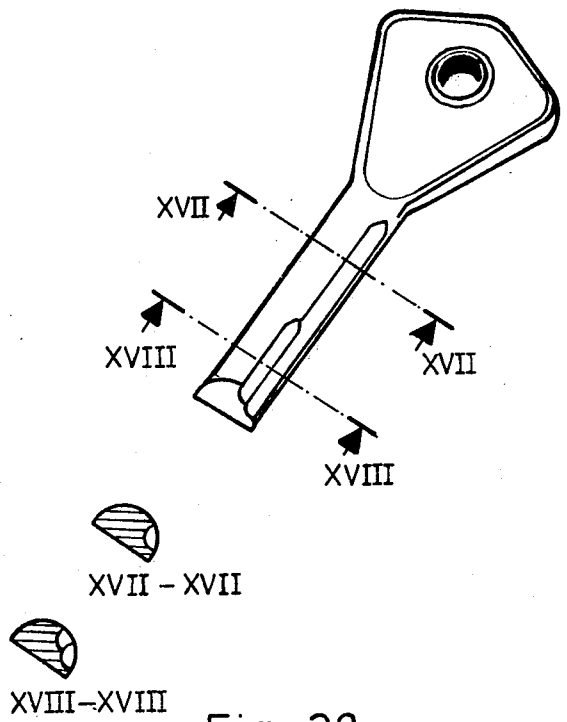
Figure 19:
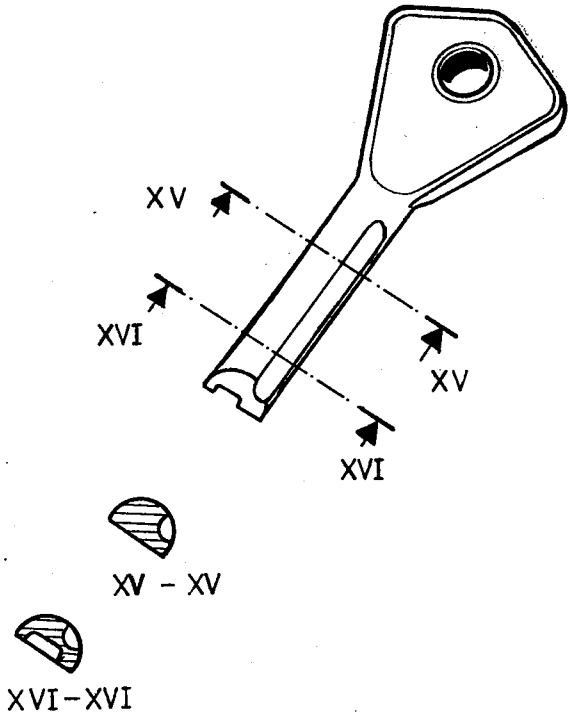

FIGS. 19 and 20 show other key profile examples.

In the embodiment shown in FIG. 19, there is a basic groove on the convex side of the key and an additional shallow groove in the flat surface of the key blank. In the embodiment shown in FIG. 20, the main groove as well as the additional groove are on the convex side of the key.

Figure 21:
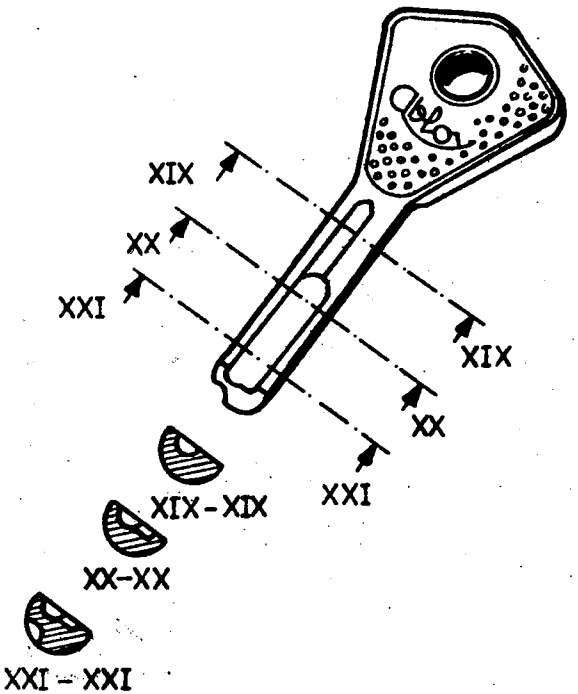

FIGS. 21 and 22 show additional examples of how different key profiles are formed at different portions of the key blade by means of grooves. The groove systems can be easily apprehended from the drawing.

By means of the key profile system according to the invention it is possible to obtain by using only ten locking disc types with a different key opening to make locks for more than 40 different key profiles in which the key profile form alters only once over the length of the key blade. Theoretically it is possible to obtain a still greater number of different profiles, but if the number of used profiles is limited so that no key profile combination fits into locks made for any of the other key profiles used and also the limitations of the manufacturing technique for making locking discs and keys are taken into account, the number of useful key profile combinations is still 52. By using profile combinations altering the profile twice over the length of the key blade, the number of useful key profile combinations can be raised several times higher.

FIG. 23 shows schematically a master key system. The shown system is so small that it is not usually necessary to use different key profiles but, in practice, considerably larger master key systems occur in which it is very advantageous to use different key profiles to obtain a greater security. This is due to the fact that a system of this kind based on only one profile covers a considerably greater number of key combinations than the number of keys in the system so that there are a greater number of key combinations outside the system which cannot be used in other locks because of the risk of an occasional occurrence of a foreign key, a so called goast key, which would fit into the master key system in question.

Figure 25:
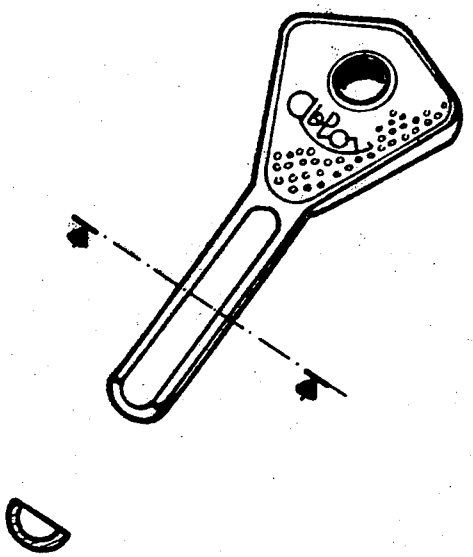
Figure 24:
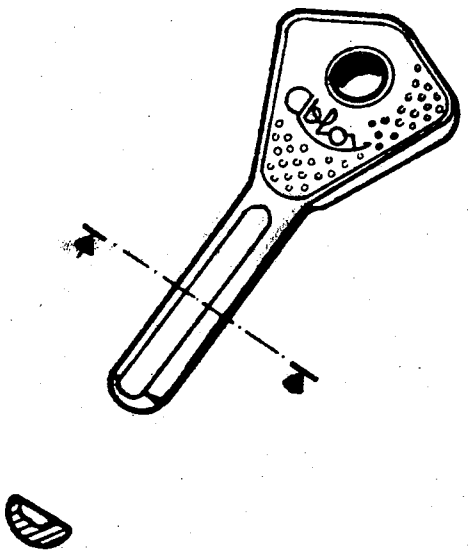
Figure 27:
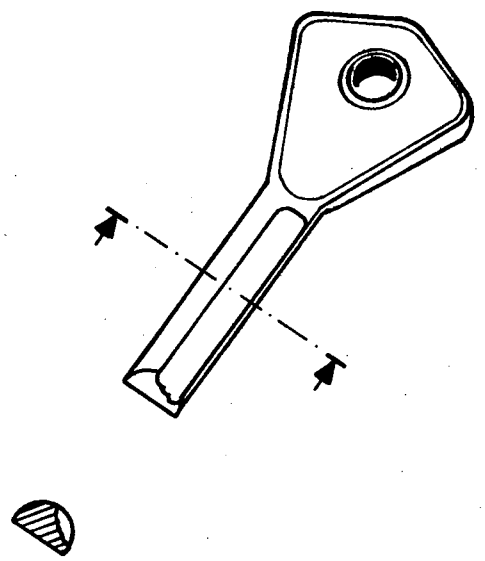
Figure 26:
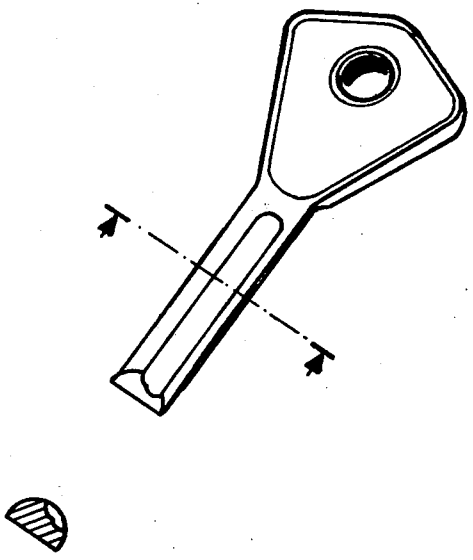

FIGS. 24 and 25 as well as FIGS. 26 and 27 show two cases in which, of two keys shown side by side, the second one always functionally fits into a lock made for the first key but not vice versa. This has been obtained merely by using different basic profiles without altering the profile over the length of the key blade.

The invention is not limited to the embodiments shown but several modifications of the invention are feasible within the scope of the attached claims.

We claim:

1. A locking system comprising several disc cylinder locks provided with turnable locking discs and several keys having different key profiles, said key profiles being of a form includable within the border line of a basic key blank profile and having at least one key profile adapted to fit functionally into a lock adapted to receive keys of another profile, said key profile being defined by a form of a key receiving opening in said turnable locking disc and having common elements of said cylinder locks respectively similar to each other.

2. A locking system as claimed in claim 1, comprising: a profile series within said basic key profile whereby each profile functionally fits into a lock made for said basic profile having at least one key profile being dimensionally excluded from use in a lock made for another key profile.

3. A locking system as claimed in claim 1, comprising at least two key profile series, whereby a profile of at least one of said series being dimensionally excluded for use in locks made for key profiles of another of said key profile series.

4. A locking system according to claim 3, including: a general key profile fitting into at least a major part of locks made for different key profiles of said key profile series.

5. A locking system according to claim 1, comprising: several key profile series, each of said series having at least one key profile adapted to fit into locks formed of at least some of said key profiles of another of said key profile series.

6. A locking system according to claim 1, comprising: keys having at least two different profiles arranged axially at the blade of said key, one after the other, whereby, of said profiles being closer to an end of said key which being first inserted into said lock, being adapted to fall within a border line of any profile more remote from said end of said key.

7. A lock as claimed in claim 1, wherein: said locking discs of said lock being provided with at least two different key opening forms, one of which corresponding to a key profile smaller than a basic profile of key blanks used in said system.

8. A key blank as claimed in claim 1, comprising: a key blade portion defined by different cross-sectional profiles at different parts of said key blade portion.

* * * * *